US006916052B2

(12) United States Patent
Yamada et al.

(10) Patent No.: US 6,916,052 B2
(45) Date of Patent: Jul. 12, 2005

(54) COVER LOCKING/UNLOCKING MECHANISM AND A PRINTER HAVING THE COVER LOCKING/UNLOCKING MECHANISM

(75) Inventors: Masahiko Yamada, Omi-mura (JP); Hideki Kawakami, Hara-machi (JP)

(73) Assignee: Seiko Epson Corporation, (JP)

( * ) Notice: Subject to any disclaimer, the term of this patent is extended or adjusted under 35 U.S.C. 154(b) by 0 days.

(21) Appl. No.: 10/799,198

(22) Filed: Mar. 12, 2004

(65) Prior Publication Data

US 2005/0069370 A1 Mar. 31, 2005

(30) Foreign Application Priority Data

Sep. 25, 2003 (JP) ..... 2003-333536

(51) Int. Cl.[7] ..... E05C 9/00; B41J 29/54

(52) U.S. Cl. ..... 292/44; 292/101; 292/194; 292/203; 400/663

(58) Field of Search ..... 400/663, 664; B41J 29/54, B41J 29/56; 312/223.2, 327, 329; 292/44, 292/45, 101, 108, 194, 203

(56) References Cited

U.S. PATENT DOCUMENTS

| | | | | |
|---|---|---|---|---|
| 5,115,272 | A * | 5/1992 | Ohmori et al. | 399/110 |
| 5,285,239 | A | 2/1994 | Negoro | 355/200 |
| 6,115,106 | A | 9/2000 | Kohda et al. | 355/64 |
| 6,464,423 | B1 * | 10/2002 | Klein | 403/322.4 |
| 6,540,268 | B2 * | 4/2003 | Pauser | 292/48 |
| 6,609,844 | B1 * | 8/2003 | Petteruti et al. | 400/88 |
| 6,789,969 | B2 * | 9/2004 | Hirabayashi et al. | 400/693 |
| 2003/0102678 | A1 * | 6/2003 | Huang | 292/102 |

FOREIGN PATENT DOCUMENTS

| | | |
|---|---|---|
| JP | 62-280065 | 12/1987 |
| JP | 4-10967 | 1/1992 |
| JP | 07-025114 | 1/1995 |
| JP | 09-240083 | 9/1997 |

(Continued)

*Primary Examiner*—Andrew H. Hirshfeld
*Assistant Examiner*—Marissa Ferguson
(74) *Attorney, Agent, or Firm*—Anderson Kill & Olick, PC

(57) ABSTRACT

A locking/unlocking mechanism for an operable cover of a body such as a printer to lock and unlock the body with a single operation and to a printer having an operable cover and a locking/unlocking mechanism for the operable cover. The operable cover is locked when a cover side engaging part in the cover engages a body-side engaging part in the body. The printer has a cover opening button 10 which is depressed to a first operating position 10B, causing a locking lever 14 in the locking/unlocking mechanism 11 to slide from a locked position 14A to an unlocked position 14B. The locking lever has an engaging channel 15 which releases the cover-side engaging part 12 of the operable cover 4, thereby disengaging the operable cover 4 but not opening it. When the cover opening button 10 is further depressed to a second (final) operating position 10C, the locking lever 14 swings vertically pivoting on a guide pin 24, which causes a cover-lifting surface 16 of the locking lever 14 to push the cover-side engaging part 12 of the operable cover 4 upward which opens the operable cover 4. The operable cover 4 is thus both unlocked and opened by simply pressing the cover opening button 10.

14 Claims, 7 Drawing Sheets

FOREIGN PATENT DOCUMENTS

| | | |
|---|---|---|
| JP | 10-016348 | 1/1998 |
| JP | 10-114129 | 5/1998 |
| JP | 10-213936 | 8/1998 |
| JP | 2001-302073 | 10/2001 |
| JP | 2002-029116 | 1/2002 |

* cited by examiner

COVER LOCKING/UNLOCKING MECHANISM AND A PRINTER HAVING THE COVER LOCKING/UNLOCKING MECHANISM

BACKGROUND OF THE INVENTION

1. Field of Technology

The present invention relates to a mechanism for locking and unlocking an operable cover in a body representing, for example, a machine such as a printer wherein the cover opens and closes a roll paper compartment and to a printer including a locking/unlocking mechanism for a cover. More specifically, the present invention relates to a locking/unlocking mechanism enabling an operable cover to be easily opened and closed with the cover unaffected by vibration and impact when in the closed position.

2. Description of Related Art

Printers having a compartment for holding roll paper or other continuous form paper inside the printer housing, and printing to the roll paper while pulling it from this compartment, are common. Such printers typically have the print head enclosed within the case of the printer, and a platen roller (paper feed roller) assembled in an operable cover with the platen roller disposed opposite the print head. The operable cover opens and closes an opening in the case for providing access to a roll paper compartment in which roll paper is loaded or removed. Opening the cover opens both the roll paper compartment and the paper path. More specifically, because the platen roller retracts with the cover and opens the paper path when the cover is opened to load or replace the roll paper, roll paper can be easily threaded through the paper path by simply inserting the roll paper in the roll paper compartment and manually pulling the end of the paper out from the compartment, and then closing the cover.

Printers with a cover of this type may also have a lock mechanism to keep the cover locked in the closed position so that the cover does not open unintentionally. This lock mechanism typically has a locking lever assembled to either the cover or the case (body), and a catch disposed on the other side so as to engage the locking lever. In one such arrangement as is described, in Japanese Unexamined Patent Appl. Pub. H09-240083 (see FIG. 6 and FIG. 7), the locking lever can rock longitudinally (front-back) to the printer, and when the cover is closed the locking lever is urged by a spring or other urging means to engage a catch either from the front or back to lock the closed cover.

When a cover locking mechanism and a separate opening mechanism for pushing the cover in the open direction are thus separately provided, an operation for releasing the locked state of the locking mechanism and a separate operation for pushing the cover open by means of the opening mechanism must be sequentially performed to open the cover. This is inconvenient because the cover cannot be opened with a single operation. Opening the cover can be made easier in this case by linking the locking mechanism and opening mechanism so that releasing the locking mechanism triggers the opening mechanism to push the cover open. However, when these operations are linked and the lock is unintentionally released by vibration or impact, the cover is easily and undesirably opened.

The present invention provides a cover locking/unlocking mechanism which permits the cover to be opened and closed with a single operation, and when the cover is in the closed position it is not sensitive to external factors such as vibration and impact.

SUMMARY OF THE INVENTION

The present invention provides a locking and unlocking mechanism (11) for a cover (4) attached to open and close to a body e.g., outside case 9 and/or main chassis 13 by pivoting on a specific shaft of rotation. This cover locking/unlocking mechanism has a cover-side engaging part (12) disposed to the cover; a body-side engaging part (engaging channel 15) for engaging the cover-side engaging part; a cover lifting part (cover-lifting surface 16) for pushing the cover-side engaging part in the direction in which the cover opens; a manual operating member (cover opening button 10) disposed to the body for releasing a locked state of the cover formed by the body-side engaging part engaging the cover-side engaging part; and a locking lever (14) which can slide, substantially in a straight line, between a locked position (14A) where the body-side engaging part engages the cover-side engaging part of the cover in a closed position (4*a*), and an unlocked control position (14B) where the locking lever is retracted a specific distance from the locked position. The locking lever can also swing between the unlocked position and an uplifted position (14C) at which the cover-side engaging part is lifted up a specific distance by the cover lifting part. When the manual operating member is operated from an initial position (10A) to a first operating position (10B), the locking lever slides from the locked position to the unlocked control position, and when the manual operating member is further operated beyond the first operating position, the locking lever swings to the uplifted position.

When the manual operating member of this invention is operated, it causes the locking lever first to slide and release the cover-side engaging part, and then to swing and push the cover up. As a result, the cover is disengaged from the locked position and thereafter opened in continuous action resulting from a single operation. The locking lever also slides so that the body-side engaging part formed as part of the locking lever engages the cover-side engaging part. This increases the engaging force between the body-side engaging part and cover-side engaging part when compared with a locking lever that swings forward and back to lock and unlock the cover. If the cover-side engaging part is a cylindrical engaging pin, and the body-side engaging part is a curved engaging channel, the cover-side and body-side engaging parts can be engaged and held with greater force by increasing the depth of this engaging channel. As a result, the lock will not disengage even as a result of external vibration or impact.

This cover locking/unlocking mechanism also preferably has a lever urging means (18) urging the locking lever to the locked position; and a return urging means (restoring spring 17) for returning the manual operating member to the initial position.

To make the manual operating member easy to operate, it is generally rendered on the top of the body so that it operates up and down, that is, substantially vertically. As a result, the locking lever slides laterally, that is, substantially horizontally, typically in the front-to-back direction of the body. This can be accomplished by rendering a swing arm (21) for converting movement of the manual operating member operated toward the first operating position in a direction different than the sliding direction to a sliding action moving the locking lever from the locked position to the unlocked position.

The locking lever is also preferably slidably supported at two places so that the locking lever can slide smoothly without play. More specifically, the cover locking/unlocking mechanism also has first and second guide pins (24, 25) assembled to the body; and first and second guide holes (14*a*, 14*b*) formed in the locking lever with the long axes of the holes aligned with the direction in which the locking lever slides. The first guide pin is inserted so that it can slide along the first guide hole, and the second guide pin is inserted so that it can slide along the second guide hole. The first guide pin and first guide hole are rendered with one on the body and the other on the locking lever. Likewise, the second guide pin and second guide hole are rendered with one on the body and the other on the locking lever.

To enable the locking lever to swing when thus configured, the body-side engaging part, cover lifting part, and second guide hole are formed at a place on one side of the first guide hole in the locking lever. A link pin (22) for linking to the swing arm, and a contact part (23) for contacting the manual operating member when the manual operating member is operated beyond the first operating position, are formed at a place on the other side of the first guide hole in the locking lever. A curved guide hole (14*c*) is formed contiguously to the end on the locked-position side of the second guide hole with the curved guide hole centered on the first guide pin when the first guide pin is at the end of the first guide hole where said pin is positioned when the first guide hole is in the locked position. A curved pin guide hole (21*b*) in which the link pin is inserted slidably is formed in the swing arm such that the curved pin guide hole is centered on the first guide pin when the first guide pin is at the end of the first guide hole where said pin is positioned when the first guide hole is in the locked position.

It will be obvious that the link pin could be rendered on the swing arm with the pin guide hole rendered on the locking lever side.

Accordingly, the second guide pin guiding the sliding of the locking lever is linked to the second guide hole and follows the curved path defined by the shape of the guide hole. The link pin connected to the swing arm also travels through a curved pin guide hole. As a result, the locking lever can pivot (swing) centered on the first guide pin from the unlocked position.

When the manual operating member is then released after the cover has opened, the manual operating member returns to its initial position and the locking lever returns to the locked position. In order to close the cover again, it is therefore necessary to slide the locking lever to the unlocked position. In order to move the locking lever to the unlocked position in conjunction with closing the cover, a guide face (inclined guide face 14*e*) is therefore rendered on the locking lever so that it contacts the cover-side engaging part as the cover-side engaging part moves toward the closed position when the locking lever is in the locked position. As a result, the force applied to this guide face from the cover-side engaging part when the cover closes causes the locking lever to slide toward the unlocked position.

The direction in which the body-side engaging part of the locking lever slides is substantially perpendicular to the tangent to the curved path of the cover-side engaging part drawn through the position where the body-side engaging part engages the cover-side engaging part.

The force holding the lock engaged can be increased by rendering the angle between this tangent and the sliding direction acute, but this increases the interference of the locking lever with movement of the cover-side engaging part, and the locking lever must therefore slide a greater distance. Conversely, if the angle between the tangent and the sliding direction is obtuse, the engaging force of the lock is reduced, and this configuration is therefore undesirable.

The cover locking/unlocking mechanism of the present invention can be used as the locking/unlocking mechanism for the cover of a printer.

This invention is also directed to a printer having a printer case, a cover for closing and opening a compartment in the printer case in which a recording medium is adapted to be stored, a feed roller for moving the recording medium along a paper path in the compartment, means for printing to the recording medium when the cover is closed and a locking/unlocking mechanism for the cover wherein said locking/unlocking mechanism comprises:

a cover-side engaging part connected to the cover;

a body-side engaging part for locking the cover to the case of the printer when engaging the cover-side engaging part;

a cover lifting part for pushing the cover-side engaging part in a direction for opening the cover;

a manual operating member for controlling the disengagement of the cover-side engaging part from the body-side engaging part to release the cover from the locked state; and a locking lever in an arrangement with the body-side engaging part and cover lifting part for sliding and swinging in a given sequence in response to movement of the manual operating member such that the locking lever slides in response to movement of the manual operating member to a first operating position for retracting the locking lever a specific distance from the locked position for disengaging the cover from the case and swings in response to movement of the manual operating member to a second operating position into an uplifted position to cause the cover lifting part to lift the cover-side engaging part up a specific distance for opening the cover.

Because the paper feed roller is held directly by the locking lever with this configuration, the paper feed roller can be precisely positioned and play in the paper feed roller can be prevented.

When a recording paper roll compartment (3) is formed in the printer case, the cover can be used to open and close the opening (3*a*) to the recording paper roll compartment.

Furthermore, if the printer is a thermal printer, that is, uses a thermal print head, the paper feed roller is assembled to the cover such that the paper feed roller contacts the print head when the cover closes; and when the cover is in the closed position, the thermal print head is pressed to the paper feed roller by an urging member.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

General Configuration

A printer 1 as is shown in FIGS. 1 through 4 respectively includes an outside case 9 representing the body of the printer 1 and a main chassis or frame 13 which is enclosed by the case 9. The printer 1 according to this embodiment of the invention is used, for example, as a portable receipt printer.

Figure 1:
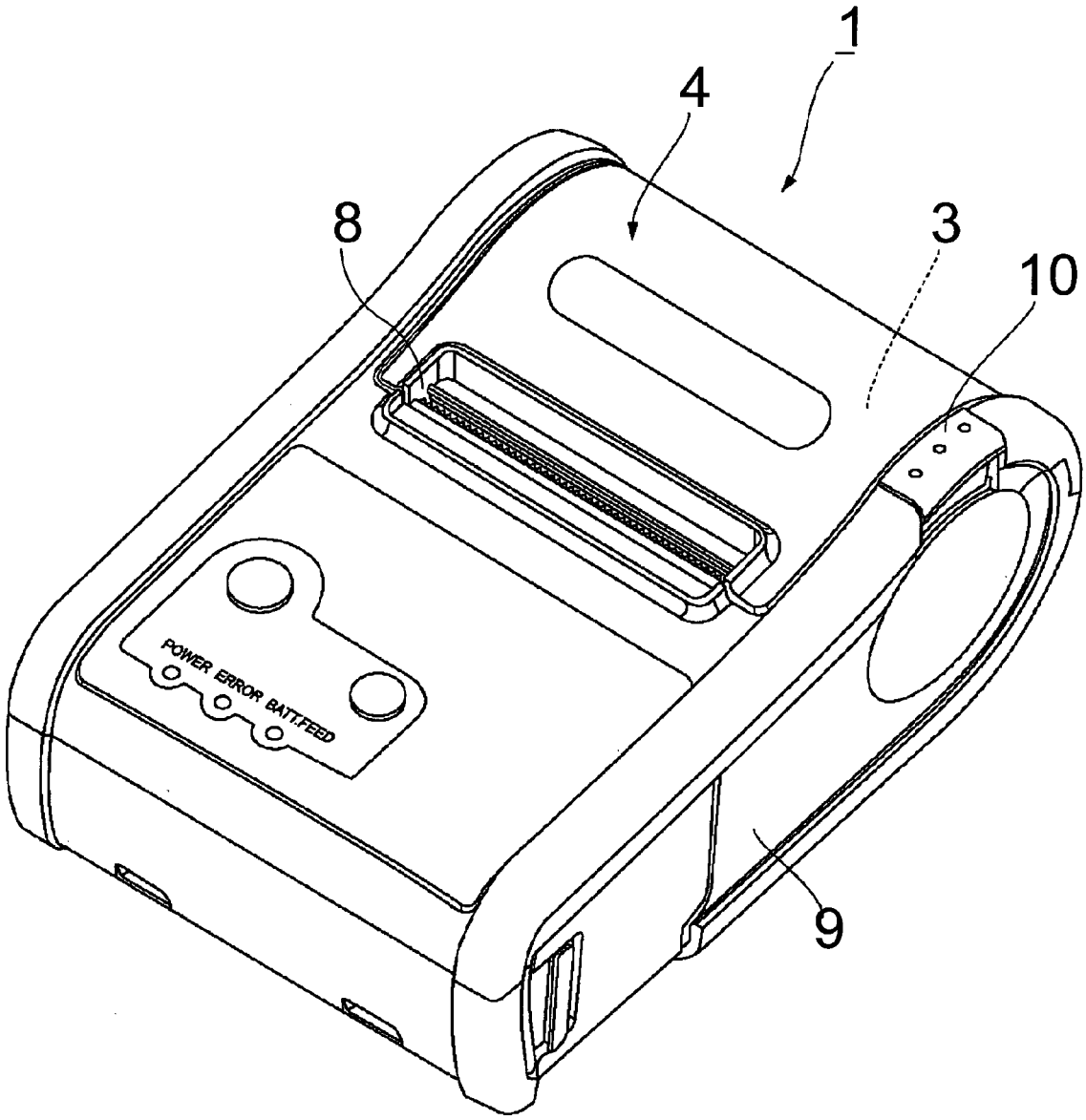
FIG. 1 is an oblique overview of a printer according to the present invention with the operable cover to the paper compartment closed.
Figure 2:
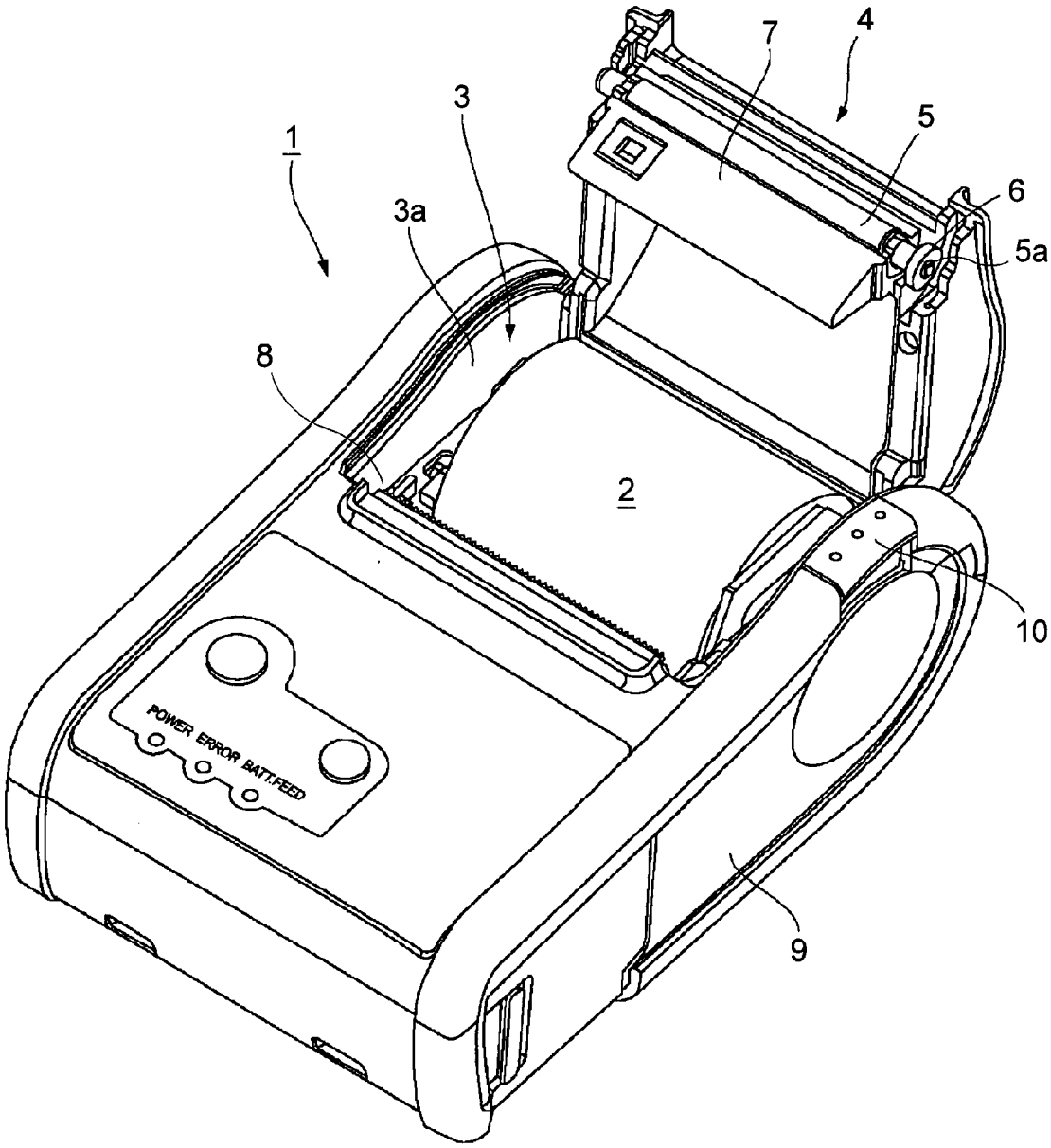
FIG. 2 is an oblique overview of a printer according to the present invention with the operable cover to the paper compartment open.

Inside the outside case 9 and at the back of the printer 1 is a compartment 3 for holding a paper roll 2. The paper roll 2 can be loaded or replaced through an opening 3*a* in the compartment 3. This opening 3*a* is normally closed by an operable cover 4 in the case 9 of the printer 1. More specifically, the operable cover 4 is pivotally hinged at the back of the printer 1 which permits rotation of the operable cover 4 between a closed position 4*a* as shown in FIG. 1 and a fully open position 4*b* as shown in FIG. 2.

A paper exit 8, in the form of an elongated opening, is formed between the distal end of the operable cover 4 and a corresponding front edge in the case 9 when the operable cover 4 is closed. The paper exit 8 extends transverse to the longitudinal axis of the printer 1 through which paper is discharged form the printer 1. The leading end of the paper roll 2 is advanced by a paper feed roller 5 through a paper path within the compartment 3 and out from the paper exit 8.

The paper feed roller 5 is supported for rotation on a roller shaft 5*a* located in the operable cover 4 extending widthwise to the printer 1 across the front of the operable cover 4. The paper feed roller 5 is connected to a driven-side gear 6 which is affixed coaxially to the right end of the roller shaft 5*a* as seen in FIG. 2. A guide plate 7 for guiding paper pulled from the paper roll 2 to the paper feed roller 5 is disposed at the front end part of the operable cover 4.

The main chassis (frame) 13 supports a thermal print head (not shown) at a location opposite the paper feed roller 5 when the operable cover 4 is closed. The print head is pushed to the paper feed roller 5 (platen roller) by an urging means such as a spring.

Figure 3:
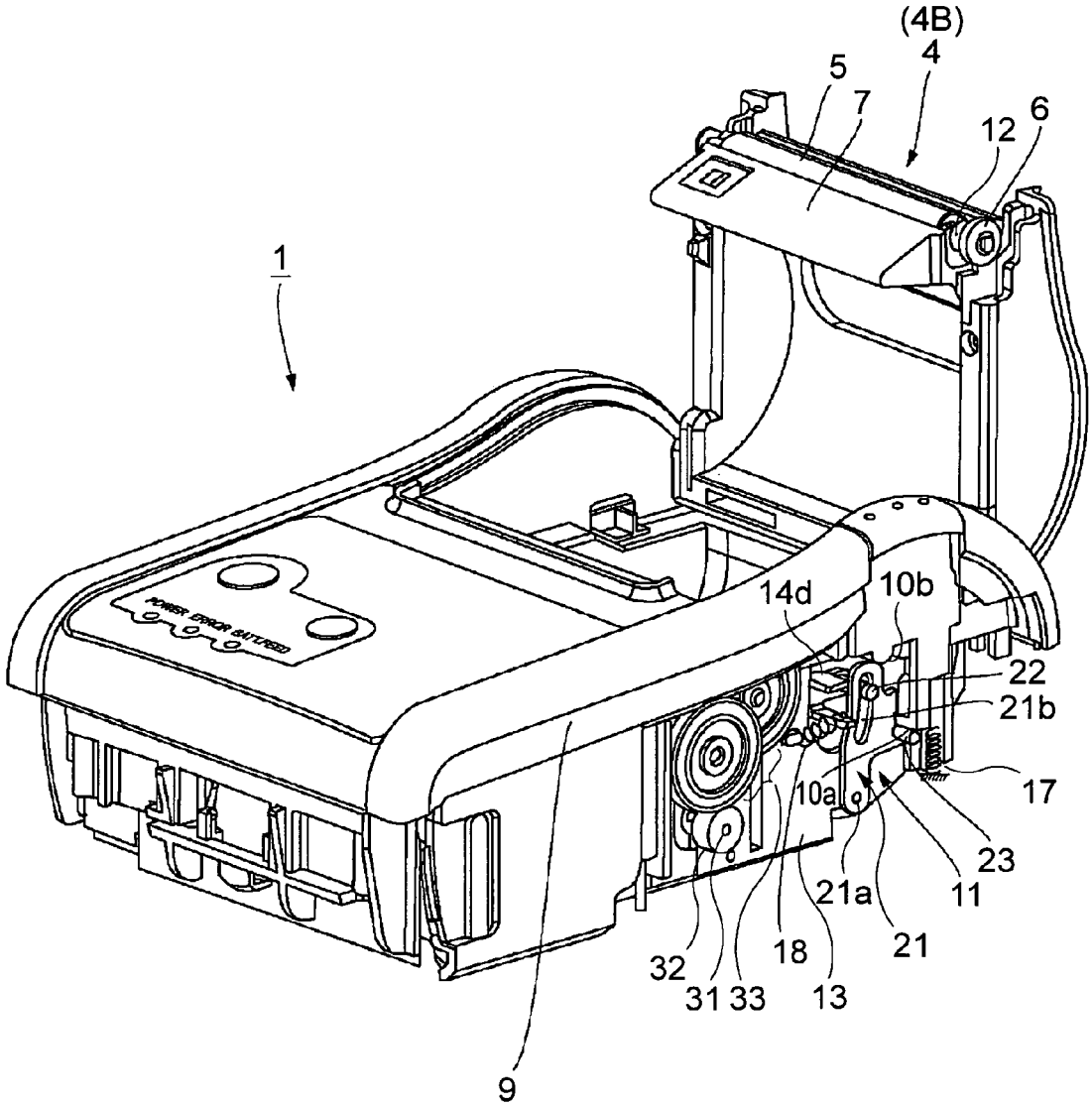
FIG. 3 is an oblique view of the printer shown in FIG. 1 with the bottom part of the outside case removed to show the locking/unlocking mechanism built in to the printer.

A paper feed motor (not shown) supported by the main chassis 13 has a motor drive shaft 31 with the distal end thereof projecting on the right side outside of the main chassis 13 and has a pinion 32 attached thereto as shown in FIG. 3. The pinion 32 engages a drive-side compound gear train 33 for rotation on the right side outside of the main chassis 13. This drive-side gear train 33 is arranged to engage the driven-side gear 6 of the operable cover 4 when the cover 4 is in the closed position 4*a*.

When the operable cover 4 is closed, the drive-side gear train 33 meshes with the driven-side gear 6 so that the paper feed roller 5 can be rotationally driven by the paper feed motor, forming a paper path through which the paper feed roller 5 conveys the paper to a printing position opposite the print head. Upon opening the operable cover 4 the paper path opens providing access to the compartment 3 through the opening 3*a* as shown in FIG. 2, which permits a paper roll 2 to be easily loaded into or removed from the compartment 3.

Paper is delivered from the paper roll 2 held in the compartment 3 and conveyed upward between the print head and paper feed roller 5 which enables, the print head to print to the paper. The printed paper is then discharged upward and out from the paper exit 8 in the top of the printer 1 located midway between the front and back ends of the printer. A cutter mechanism (not shown in the figure) is disposed directly below the paper exit 8 and cuts the paper after printing ends so that it can be issued as a receipt, for example.

The operable cover 4 is locked to the case 9 in the closed position 4*a* by a locking/unlocking mechanism 11. When the operable cover 4 is unlocked from the case 9, the locking/unlocking mechanism 11 also pushes the distal end of the operable cover 4 to a released position 4*c* upward a specific distance in the opening direction from the closed position 4*a*. The released position 4*c* is a position in which the operable cover 4 is unlocked from the case 9 but has not necessarily been raised into the open position 4*b*. However, because the distal end of the operable cover 4 is disengaged and completely freed from the case 9, i.e., once the cover is pushed up the operable cover 4 can then be easily rotated into the fully open position 4*b*. A torsion spring or other urging member could also be provided to automatically urge the operable cover 4 toward the open position 4*b* so that once the operable cover 4 is pushed up this specific distance by the locking/unlocking mechanism 11, the urging member will automatically rotate the operable cover 4 into the open position 4*b*.

A cover opening button 10 (manual operating member) is also disposed on the right side at the back of the outside case 9 of the printer 1. When this cover opening button 10 is operated, it operates the locking/unlocking mechanism 11 to release the lock holding the operable cover 4 to the case 9 and pushes the operable cover 4 open.

Locking/Unlocking Mechanism

Figure 4A:
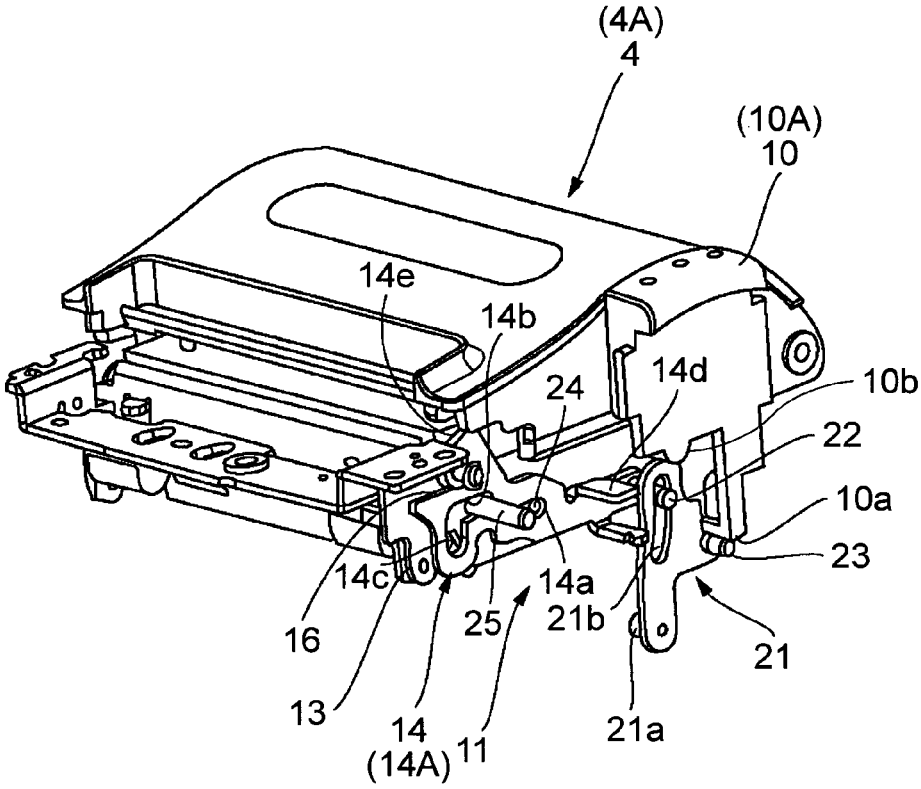
FIG. 4A and FIG. 4B are a partial oblique view and partial side section view showing the locking/unlocking mechanism and the operable cover in the closed position.
Figure 4B:
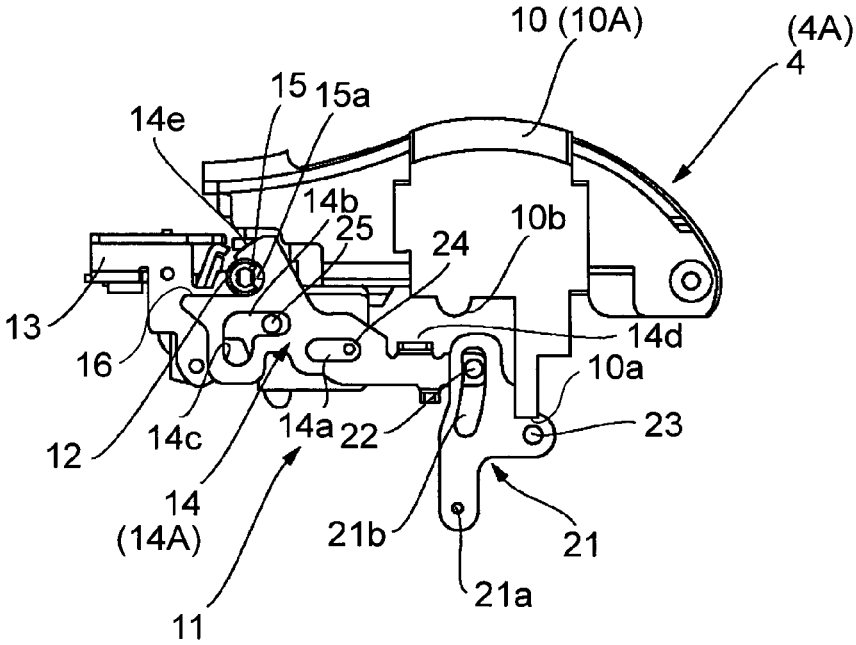
Figure 5A:
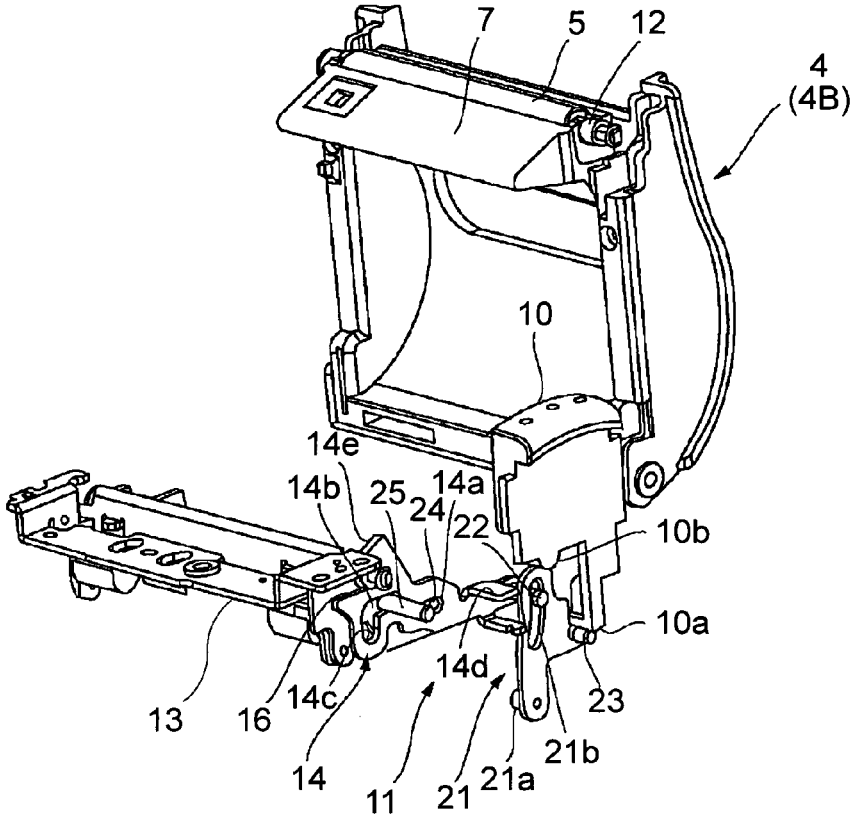
FIG. 5A and FIG. 5B are a partial oblique view and partial side section view showing the locking/unlocking mechanism and the operable cover in the open position.
Figure 5B:
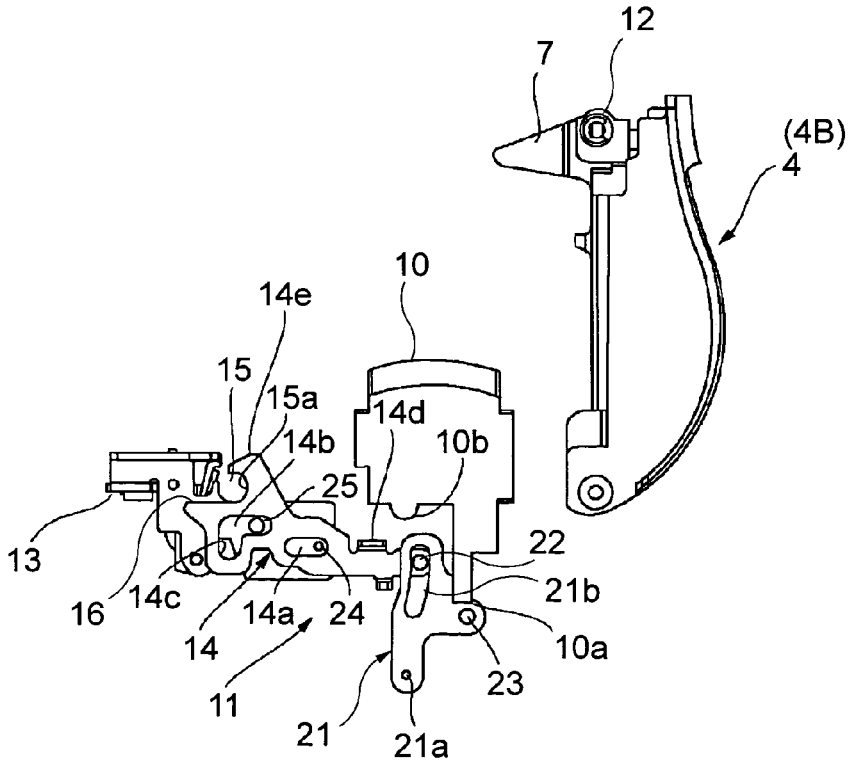

FIG. 3 is an oblique view of the printer with the bottom part of the outside case 9 removed to show the locking/unlocking mechanism 11 whereas FIG. 4A and FIG. 4B show an exploded view of the locking/unlocking mechanism 11 with the operable cover 4 in the closed position 4*a* and FIG. 5A and FIG. 5B show an exploded view of the locking/unlocking mechanism with the operable cover 4 in the open position 4*b*. The locking/unlocking mechanism 11 of this invention is hereafter described with reference to these figures.

A freely rotating, cylindrical cover-side engaging part 12 is assembled in the operable cover 4 connected to the inside of the driven-side gear 6 on the roller shaft 5*a* of the paper feed roller 5. Note that the driven-side gear 6 is not shown in FIG. 4A and FIG. 4B or FIG. 5A and FIG. 5B. The right and left side ends of the roller shaft 5*a* are supported by bearing members (not shown) in the operable cover 4. The bearing member on the right end side is also functioning as the cover-side engaging part 12 in this embodiment of the invention.

A locking lever 14 is disposed on the right side of the main chassis 13 to which the outside case 9 is attached. A substantially semicircular engaging channel 15 (chassis-side engaging member) that opens to the front of the printer is formed in the front end part of the locking lever 14. A cover-lifting surface 16 (cover lifting member) projects horizontally to the front of the printer 1 when the operable cover 4 is in the locked position. The cover-lifting surface 16 is formed contiguously with the bottom end of the curved inside surface 15*a* of the engaging channel 15. When the operable cover 4 is in the closed position, the cover-side engaging part 12 of the operable cover 4 fits in the engaging channel 15 of the locking lever 14 thereby locking the operable cover 4 to the case 9. This locked position is shown in FIG. 4A and FIG. 4B.

Figure 6A:
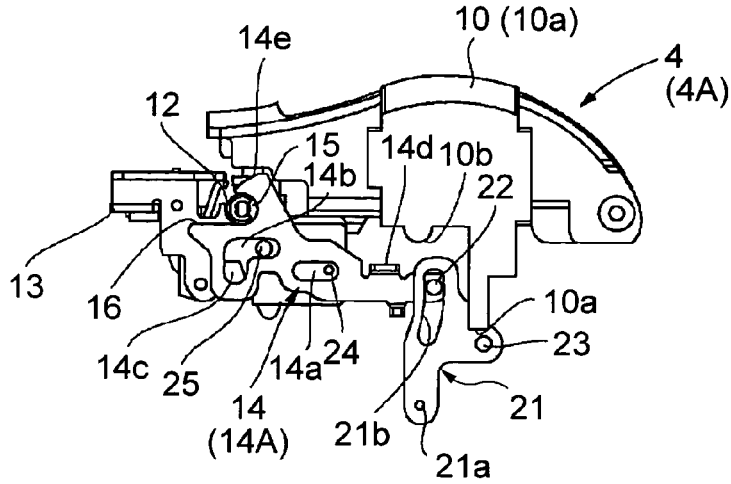
FIG. 6A to FIG. 6C describe operation of the locking/unlocking mechanism.
Figure 6B:
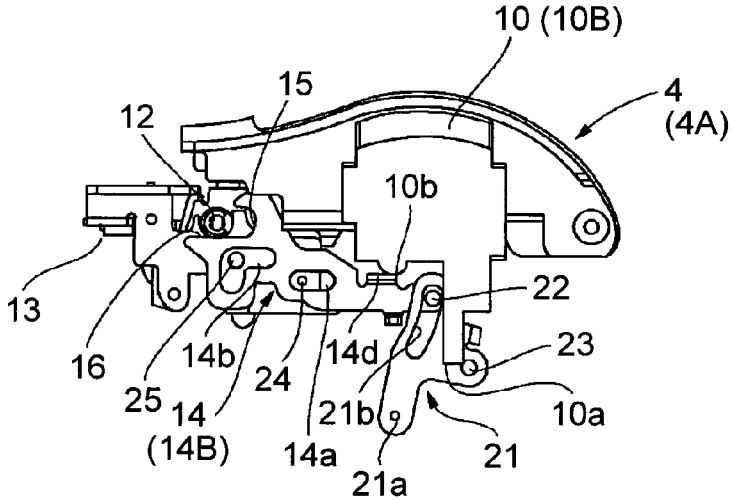

The locking lever 14 can slide linearly between the locked position 14A shown in FIG. 4A and FIG. 4B, and the unlocked position 14B shown in FIG. 6B. In the locked position 14A, the cover-side engaging part 12 of the operable cover 4 is engaged in the engaging channel 15. The locking lever 14 can then slide along a substantially straight line from this locked position 14A a specific distance to the back of the printer to the unlocked position 14B. When the locking lever 14 reaches this unlocked position 14B, the cover-side engaging part 12 is pushed up a specific distance by the cover-lifting surface 16 and the locking lever 14 can then swing to the uplifted position 14C shown in FIG. 6C. This operation of the locking lever 14 occurs in conjunction with the depression of the cover opening button 10.

In the present embodiment when the cover opening button 10 is depressed from the initial position 10A shown in FIG. 4A and FIG. 4B to a first operating position 10B (see FIG. 6B), the locking lever 14 slides from the locked position 14A to the unlocked position 14B. When the cover opening button 10 is further depressed from this first operating position 10B to a second operating position 10C (final operating position, see FIG. 6C), the locking lever 14 swings to the uplifted position 14C in conjunction with the downward depression (movement) of the cover opening button 10.

The cover opening button 10 is constantly being pushed upward to the initial position 10A by a restoring spring 17 (see FIG. 3), and the force of this restoring spring 17 returns the cover opening button 10 to the initial position 10A when the downward pressure on the cover opening button 10 is released. A coil spring or other urging means 18 (FIG. 3) also constantly urges the locking lever 14 to the locked position 14A.

A swing arm 21 for converting the downward motion of the cover opening button 10 to the sliding motion of the locking lever 14 is also disposed between the cover opening button 10 and locking lever 14. This swing arm 21 is assembled to the main chassis 13 so that it can swing from front to back on a support stud 21*a* affixed to the bottom end of the swing arm 21. A guide hole 21*b* (pin guiding hole) is formed with a vertically long curved shape at the top end of the swing arm 21.

A link pin 22 is affixed at the back end of the locking lever 14, which is assembled with the link pin 22 inserted thereto so that it can slide along this guide hole 21*b*. An engaging pin 23 is further affixed to this swing arm 21. This engaging pin 23 is positioned to the back of the support stud 21*a* approximately centered vertically to the swing arm 21.

A depressing face 10*a* is formed on a projection of the cover opening button 10 extending vertically downward from the bottom back side of the cover opening button 10 with this depressing face 10*a* positioned above the engaging pin 23.

As a result, the depressing face 10*a* thus contacts the engaging pin 23 when the cover opening button 10 is pushed down, and as the cover opening button 10 is depressed further, the cover opening button 10 causes the swing arm 21 to slide to the back pivoting on the support stud 21*a*. The cover opening button 10 travels substantially vertically while the engaging pin 23 of the swing arm 21 traces a curved path.

The engaging pin 23 is set in this embodiment so that it separates from the depressing face 10*a* to the back of the printer when the cover opening button 10 reaches the first operating position 10B. More specifically, the engaging pin 23 contacts the depressing face 10*a* until the cover opening button 10 reaches the first operating position 10B, at which point the engaging pin 23 contacts the back side of the projection on which the depressing face 10*a* is formed as shown in FIG. 6B.

Also formed in the locking lever 14 are first and second guide holes 14*a* and 14*b*, each being an elliptical hole with the long axis oriented front-back to the printer. First and second guide pins 24 and 25 affixed to the side of the main chassis 13 are inserted to and slide relatively along these guide holes 14*a* and 14*b*. The first guide hole 14*a* is formed approximately in the front-back center of the locking lever 14, and the second guide hole 14*b* is formed to the front side of and slightly above the first guide hole 14*a*. The locking lever 14 is held level by and can slide horizontally front-to-back on the two guide pins 24 and 25.

Extending contiguously downward from the front end of second guide hole 14*b* is a curved guide hole 14*c* centered on the first guide pin 24, which is positioned at the front end in the first guide hole 14*a* when the locking lever 14 is slid backward in the unlocked position 14B. The curved guide hole 21*b* in the swing arm 21 is also a curved guide hole centered on the first guide pin 24 positioned at the front end of the first guide hole 14*a*.

A contact member 14*d* extends horizontally from the locking lever 14 between the first guide hole 14*a* and the link pin 22 affixed at the back end of the locking lever 14. A depressing surface 10*b* projecting downward in a semicircle is also formed on the front bottom edge of the cover opening button 10 and is positioned above the surface of the contact member 14*d*.

After the cover opening button 10 is depressed to the first operating position 10B and the engaging pin 23 separates from depressing face 10*a* to the back, this depressing surface 10*b* contacts the contact member 14*d*. When the cover opening button 10 is then pressed further down, the back end part of the locking lever 14 is pushed down. This downward movement thus causes the front end of the locking lever 14 to swing up pivoting on the first guide pin 24 inserted to the first guide hole 14*a*.

An inclined guide face 14*e* sloping upward and to the back contiguously from the top of the curved inside surface 15*a* of the engaging channel 15 is also formed on the top side of the engaging channel 15 in the locking lever 14. The position of this inclined guide face 14*e* is determined so that if the operable cover 4 is closed when the locking lever 14 is in the locked position 14A, the cover-side engaging part 12 will contact the inclined guide face 14*e*.

Locking and Unlocking Operations

Operation of the locking/unlocking mechanism 11 for unlocking the operable cover 4 will now be described starting with the operable cover 4 in the locked position as shown in FIG. 6A.

In this position the locking lever 14 is in locked position 14A, and the cover-side engaging part 12 of operable cover 4 is engaged by the engaging channel 15 of the locking lever 14.

When the cover opening button 10 is then operated and depressed to the first operating position 10B, the engaging pin 23 of the swing arm 21 is pushed down by the downward motion of the cover opening button 10, and the swing arm 21 swings back. The swing arm 21 is linked to the back end of the locking lever 14 by the link composed of curved guide hole 21*b* and link pin 22 which causes the locking lever 14 to slidably move front-to-back by the two guide pins 24 and 25. Therefore, when the swing arm 21 swings back as shown in FIG. 6B, the locking lever 14 slides horizontally back to the unlocked position 14B, and the lock on the operable cover 4 is released. At this point the cover-side engaging part 12 is separated from the engaging channel 15 in the locking lever 14, but remains resting on the cover-lifting surface 16.

Figure 6C:
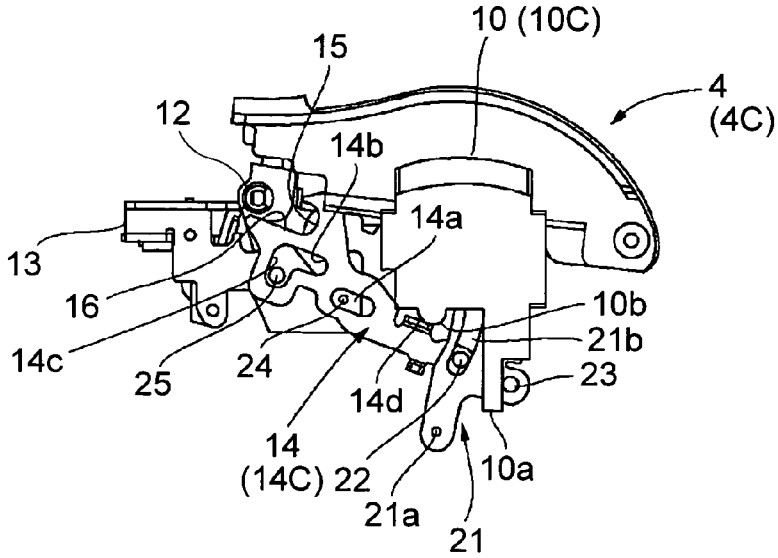

When the cover opening button 10 is then pressed further downward, the depressing face 10*a* disengages the engaging pin 23 of the swing arm 21. The front depressing surface 10*b* of the cover opening button 10 then contacts contact member 14*d* of locking lever 14, and the locking lever 14 now swings in the vertical direction (clockwise as seen in the figure) on the first guide pin 24. As a result, the cover-lifting surface 16 at the distal end of the locking lever 14 lifts the cover-side engaging part 12 riding thereon. As a result, when the cover opening button 10 is depressed to second (final) operating position 10C, the locking lever 14 swings to the uplifted position 14C, and the operable cover 4 is pushed upward a specific distance and opens to the released position 4C where it is completely freed from the printer body as shown in FIG. 6C.

Figure 7A:
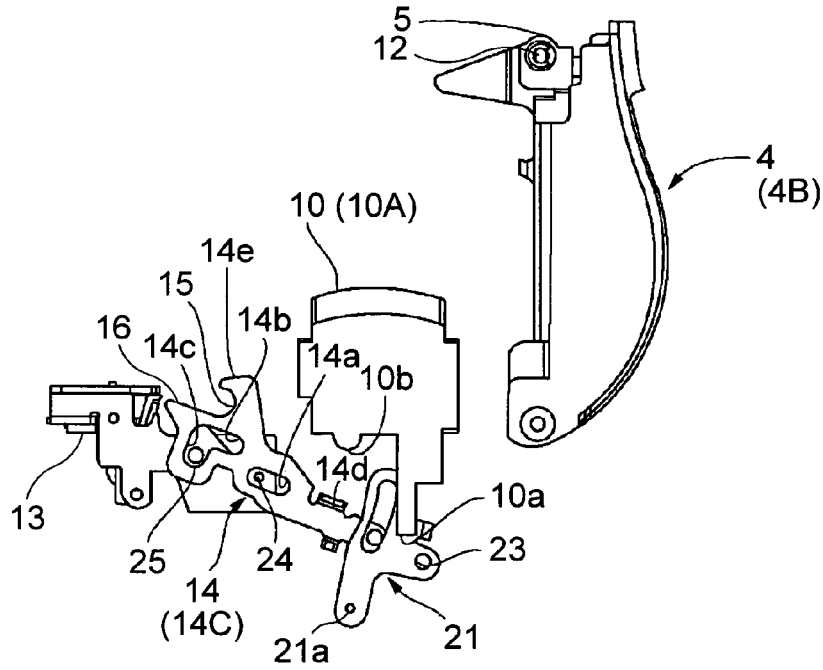
FIG. 7A to FIG. 7C describe operation of the locking/unlocking mechanism.

The operable cover 4 can thereafter be manually further opened to the fully open position 4B shown in FIG. 7A, or, as noted hereinabove, the operable cover 4 can be opened automatically to the full open position 4B by means of a torsion spring or other urging means. When the downward pressure on the cover opening button 10 is removed, the cover opening button 10 is raised by the restoring spring 17 and returns to the initial position 10A. The force of urging means 18 also returns the locking lever 14 from the uplifted position 14C to the unlocked position 14B, and from there to the locked position 14A. This position is shown in FIG. 7B.

Figure 7B:
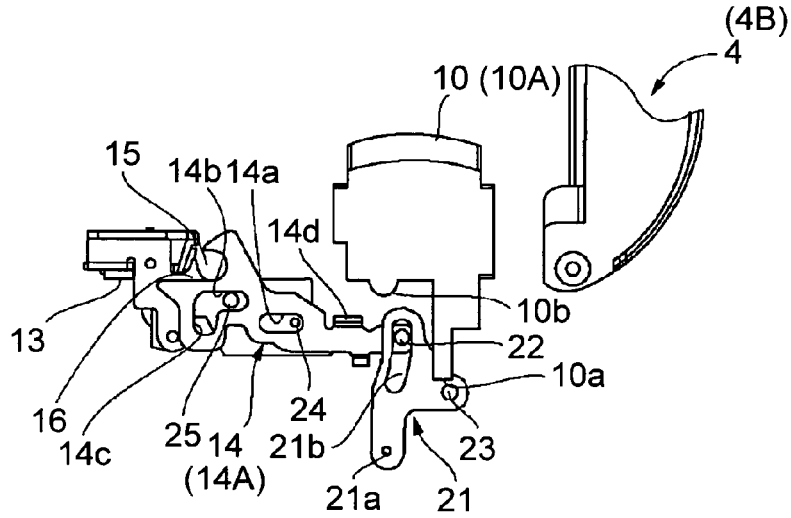
Figure 7C:
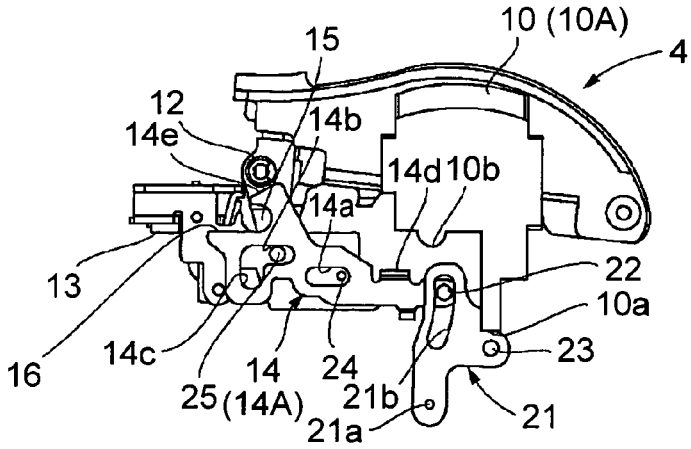

When the operable cover 4 is then manually closed from the position shown in FIG. 7B, the cover-side engaging part 12 contacts the inclined guide face 14*e* of the locking lever 14 in the locked position 14A. Therefore, when the operable cover 4 is pushed down, the locking lever 14 slides toward unlocked position 14B in resistance to the urging force of the urging means 18. Then when the cover-side engaging part 12 slides off the inclined guide face 14*e*, the locking lever 14 slides toward locked position 14A, and because the engaging channel 15 communicates with the bottom end of the inclined guide face 14*e*, the cover-side engaging part 12 slips from the bottom end of the inclined guide face 14*e* into the engaging channel 15 from the front. Provision of this inclined guide face 14*e* on the locking lever 14 thus means that when the operable cover 4 is closed, the operable cover 4 is automatically locked in position. It should be noted that because the cover-side engaging part 12 rotates freely, it reduces the friction with the locking lever 14 when the operable cover 4 closes.

It is therefore possible with the locking/unlocking mechanism 11 as described above to unlock the operable cover 4 and raise the unlocked operable cover 4 by means of the simple operation of pushing down on the cover opening button 10.

The locking lever 14 also slides in a straight line front-to-back between locked and unlocked positions. In this embodiment of the invention the locking lever 14 engages the cover-side engaging part 12 from a direction substantially perpendicular to a tangent to the arc of the path traveled by the cover-side engaging part 12 on the operable cover 4. As a result, the engaging channel 15 can be made deeper than when using a locking lever that swings in an arc, and stronger engagement between the engaging channel 15 and cover-side engaging part 12 can be afforded. The problem of the lock disengaging and the cover opening unintentionally when vibration or impact acts on the lock is thereby avoided. This configuration is therefore particularly beneficial in compact, portable printers that are susceptible to vibration and impact when carried.

It should also be noted that the cover-side engaging part 12 is affixed to the roller shaft 5*a* of the paper feed roller 5 in this embodiment of the invention. As a result, the position of the paper feed roller 5 when the operable cover 4 is closed is fixed directly by the locking/unlocking mechanism 11. The paper feed roller 5 can therefore be precisely positioned, and play in the paper feed roller 5 can be prevented.

Other Embodiments

Although this invention has been described above with reference to a locking/unlocking mechanism for use with an operable cover in a printer it is obvious that it is equally applicable as a locking/unlocking mechanism for a cover in facsimile machines and other non-printer devices.

Furthermore, while a thermal printer is used by way of example above, the present invention can also be applied to other types of printers, including inkjet head and impact head printers.

Yet further, the cover-side engaging part is an engaging pin and the case-side engaging part is a channel in the above embodiment, but the cover-side engaging part could be a channel and the case-side engaging part could be a pin.

Furthermore, a guide hole could be rendered on the side on which a pin is rendered in the above embodiment, and a pin could be rendered on the side in which a guide hole is rendered in the above embodiment.

When the manual operating member of the cover locking/unlocking mechanism of the present invention is operated to a first operating position, the locking lever slides and the operable cover is unlocked. When the manual operating member is then operated further, the locking lever swings and pushes the operable cover open. A single operation of the manual operating member can thus both unlock the cover and open the cover.

Furthermore, because the locking lever slides in a substantially straight line to lock the operable cover in a closed position, the lock engaging part of the locking lever engages the lock engaging part of the operable cover more strongly than configurations in which the locking lever moves in an arc in order to lock and unlock.

This invention thus provides a locking/unlocking mechanism that can both unlock and release an operable cover with a single operation, and prevent problems such as the cover opening unintentionally because the lock was accidentally released by applied vibration or impact.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A locking/unlocking mechanism for a cover connected to a body for opening and closing the body, comprising:

a cover-side engaging part connected to the cover;

a body-side engaging part for locking the cover to the body when engaging the cover-side engaging part;

a cover lifting part for pushing the cover-side engaging part in a direction for opening the cover;

a manual operating member disposed to the body for controlling the disengagement of the cover-side engaging part from the body-side engaging part for releasing the cover from the locked state; and a locking lever disposed to the body in an arrangement with the body-side engaging part and cover lifting part for sliding and swinging the locking lever in a given sequence in response to movement of the manual operating member such that the locking lever slides in response to movement of the manual operating member to a first operating position from a locked position in which the body-side engaging part engages the cover-side engaging part wherein when the manual operating member is moved to the first operating position the locking lever is retracted a specific distance to a control position and the cover is unlocked; and swings in response to movement of the manual operating member to a second operating position into an uplifted position to cause the cover lifting part to lift the cover-side engaging part up a specific distance for opening the cover.

2. The locking/unlocking mechanism of claim 1, further comprising:

a lever urging means for urging the locking lever to the locked position; and a return urging means for urging the return of the manual operating member to an initial position.

3. The locking/unlocking mechanism of claim 1, further comprising:

a swing arm for converting movement of the manual operating member operated toward the first operating position to the sliding action of the locking lever.

4. The locking/unlocking mechanism of claim 3, further comprising:

first and second guide pins; and first and second guide holes formed in the locking lever extending in the sliding direction;

wherein the first guide pin is mounted in the first guide hole, and the second guide pin is mounted in the second guide hole with the first and second guide pins controlling the sliding movement of the locking lever.

5. The locking/unlocking mechanism of claim 4, wherein:

the body-side engaging part, cover lifting part, and second guide hole are formed at a place on one side of the first guide hole in the locking lever;

a link pin for linking to the swing arm, and a contact part for contacting the manual operating member when the manual operating member is moved from the first operating position into or toward the second operating position;

a curved guide hole extending from the locked-position side of the second guide hole such that the curved guide hole is centered on the first guide pin when the first guide pin is positioned at the end on the locked-position side of the first guide hole; and a curved pin guide hole into which the link pin is slidably inserted to enable the curved pin guide hole to become centered on the first guide pin when the first guide pin is positioned at the end on the locked-position side of the first guide hole.

6. The locking/unlocking mechanism of claim 3, further comprising:

a first guide pin disposed in the body or in the locking lever;

a second guide pin disposed in the body or in the locking lever;

a first guide hole extending in the sliding direction in the body or in the locking lever based upon the opposed disposition of the first guide pin in the body or locking lever; and a second guide hole extending in the sliding direction in the body or in the locking lever based upon the opposed disposition of the second guide pin in the body or locking lever;

wherein the first guide pin is inserted slidably in the first guide hole, and the second guide pin is inserted slidably in the second guide hole.

7. The locking/unlocking mechanism of claim 6, wherein:

the body-side engaging part, cover lifting part, and second guide pin or second guide hole are rendered to a part on one side of the first guide pin or the first guide hole of the locking lever;

a contact part positioned relative to the manual operating member to make contact therewith when the manual operating member is moved between the first operating position and second operating position with said contact part being formed at a place on another side of the first guide pin or first guide hole of the locking lever;

a curved guide hole extending from the locked-position side of the second guide hole and with the curved guide hole centered on the first guide pin when the first guide pin is at the end of the first guide hole where said pin is positioned when the first guide hole is in the locked position;

a link pin for linking to the locking lever or to the swing arm; and a curved pin guide hole in which the link pin is slidably inserted to enable the locking lever or swing arm to cause the curved pin guide hole to become centered on the first guide pin when the first guide pin is at the end of the first guide hole and when the first guide hole is in the locked position.

8. The locking/unlocking mechanism of claim 1, wherein:

the locking lever comprises a guide face for contacting the cover-side engaging part as the cover-side engaging part moves toward the closed position thereby enabling the locking lever to slide from the locked position toward the unlocked position when force is applied from the cover-side engaging part to said guide face.

9. The locking/unlocking mechanism of claim 1, wherein:

the sliding direction of the body-side engaging part of the locking lever is substantially perpendicular to a tangent to the curved path of the cover-side engaging part drawn through the position where the body-side engaging part engages the cover-side engaging part.

10. The locking/unlocking mechanism of claim 1, wherein:

the body is a printer case for a printer.

11. The locking/unlocking mechanism of claim 10 wherein the cover has a distal end part and wherein the printer comprises:

a paper feed roller assembled to the distal end part of the cover having a paper feed roller shaft;

a print head assembled in the printer case;

with said cover-side engaging part being aligned coaxially with said paper feed roller shaft; and wherein said paper feed roller is adapted to convey a recording medium past a printing station in said printer when the cover is closed.

12. The locking/unlocking mechanism of claim 11, wherein the printer further comprises:

a recording paper roll compartment formed in the printer case; and an opening in the printer case which is opened and closed by said cover with said opening providing access to said recording paper roll compartment when the cover is opened.

13. A printer having a printer case, a cover for closing and opening a compartment in the printer case in which a recording medium is adapted to be stored, a feed roller for moving the recording medium along a paper path in the compartment, means for printing to the recording medium when the cover is closed and a locking/unlocking mechanism for the cover wherein said locking/unlocking mechanism comprises:

a cover-side engaging part connected to the cover;

a body-side engaging part for locking the cover to the case of the printer when engaging the cover-side engaging part;

a cover lifting part for pushing the cover-side engaging part in a direction for opening the cover;

a manual operating member for controlling the disengagement of the cover-side engaging part from the body-side engaging part to release the cover from the locked state; and a locking lever in an arrangement with the body-side engaging part and cover lifting part for sliding and swinging in a given sequence in response to movement of the manual operating member such that the locking lever slides in response to movement of the manual operating member to a first operating position for retracting the locking lever a specific distance from the locked position and for disengaging the cover from the case and swings in response to movement of the manual operating member to a second operating position into an uplifted position to cause the cover lifting part to lift the cover-side engaging part up a specific distance for opening the cover.

14. The printer of claim 13, further comprising a print head wherein:

the paper feed roller is assembled to the cover such that the paper feed roller contacts the print head when the cover closes; and an urging member for pressing the print head to the paper feed roller when the cover is in the closed position.

* * * * *